US006612528B2

(12) United States Patent
Collins et al.

(10) Patent No.: US 6,612,528 B2
(45) Date of Patent: Sep. 2, 2003

(54) COMPOUND MOUNTING BRACKET FOR A SOLENOID

(75) Inventors: Terence L. Collins, Mount Prospect, IL (US); Peter J. Stocco, Streamwood, IL (US); Joseph L. Schneider, Chicago, IL (US); Richard P. Kolb, Prairie View, IL (US)

(73) Assignee: Synchro-Start Products, Inc., Niles, IL (US)

( * ) Notice: Subject to any disclaimer, the term of this patent is extended or adjusted under 35 U.S.C. 154(b) by 7 days.

(21) Appl. No.: 10/046,829

(22) Filed: Jan. 15, 2002

(65) Prior Publication Data

US 2003/0132358 A1 Jul. 17, 2003

(51) Int. Cl.[7] ..... A47F 5/00
(52) U.S. Cl. ..... 248/300; 248/674; 74/606 R
(58) Field of Search ..... 248/610, 300, 248/612, 62, 314, 315, 500, 674; 74/606 R

(56) References Cited

U.S. PATENT DOCUMENTS 1,905,540 A * 4/1933 Whitehouse ..... 248/612
3,270,992 A * 9/1966 Cassel ..... 248/60
3,942,599 A * 3/1976 Shimada ..... 180/292
3,971,540 A * 7/1976 Johnson et al. ..... 251/143
4,109,221 A * 8/1978 Pauli ..... 335/251
5,521,795 A * 5/1996 Burgett et al. ..... 248/500
5,855,354 A * 1/1999 Fisher et al. ..... 248/674
6,085,615 A * 7/2000 Kirkendall ..... 74/606 R
6,230,585 B1 * 5/2001 Bator ..... 74/606 R

OTHER PUBLICATIONS

Product Catalog entitled, "70 Years of Defining and Refining Solenoid and Engine Control Technology", Synchro–Start Products, Inc., 2002.

* cited by examiner

*Primary Examiner*—Anita King
(74) *Attorney, Agent, or Firm*—Wallenstein & Wagner, Ltd.

(57) ABSTRACT

A compound mounting bracket for attaching a solenoid to a structure is disclosed. The compound mounting bracket comprises a first and second plate, each having a first edge and a second distal edge. The second distal edge of the first plate is connectable to a first mounting point on a solenoid. The second distal edge of the second plate extends in a direction generally transverse to the first edge of the second plate, thereby defining a dihedral angle between the first plate and the second plate. The second plate is connectable at its second distal edge to a second mounting point on the solenoid.

15 Claims, 1 Drawing Sheet

COMPOUND MOUNTING BRACKET FOR A SOLENOID

TECHNICAL FIELD

The invention relates to a mounting bracket, and more particularly to a compound mounting bracket for attaching a solenoid to a structure.

BACKGROUND OF THE INVENTION

Solenoid devices are often used in connection with fuel-injected engines to actuate the fuel injectors. Solenoids used in connection with such applications are generally mounted in areas that are limited by spacial constraints such as engine compartments of diesel trucks. Accordingly, the size of solenoid bracket assemblies must be minimized in order to optimize space.

While minimizing the size of solenoid bracket assemblies is important, solenoids such as those described above are typically mounted in areas in which high vibrational forces are generated. Thus, it is also important to provide a mounting system capable of withstanding stresses imposed on the mounting bracket. In particular, it is important to provide a bracket that will overcome stresses imposed on the mounting bracket resulting from vibration to ensure that the solenoid remain secure.

In the past, mounting bracket assemblies have been employed which consist of a singular metal plate. Such mounting brackets entirely encircle the circumference of the solenoid housing. While mounting brackets such as these have enjoyed some degree of success, such mounting brackets do not make optimal use of space while simultaneously satisfying minimal vibrational thresholds.

Furthermore, such mounting brackets are difficult to use in connection with solenoids having a relatively large diameter. The present invention is provided to solve these and other problems, and to provide advantages and aspects not provided by prior solenoid mounting bracket assemblies.

SUMMARY OF THE INVENTION

The present invention provides a compound mounting bracket for attaching a solenoid to a structure. The mounting bracket comprises a first and second plate, each having a first edge and a second distal edge. The second distal edge of the first plate is connectable to a first mounting point on a solenoid. The second distal edge of the second plate extends in a direction generally transverse to the first edge of the second plate, thereby defining a dihedral angle between the first plate and the second plate. The second plate is connectable at its second distal edge to a second mounting point on the solenoid.

According to another aspect of the present invention, a method for attaching a solenoid to a mounting bracket is provided. The method comprising the steps of providing a solenoid having a generally cylindrical housing, as well as the mounting bracket described above. The method also includes the step of applying a first weld between the first edge of the first plate and the first edge of the second plate, and applying a second weld to the mounting bracket between the first second plate proximate the dihedral angle. The method further comprises the step of applying a third weld between the second distal edge of the first plate and the solenoid housing, and applying a fourth weld between the second edge distal edge of the second plate and the solenoid housing.

These and other objects and advantages will be made apparent from the following description of the drawings and detailed description of the invention.

DETAILED DESCRIPTION

Figure 3:
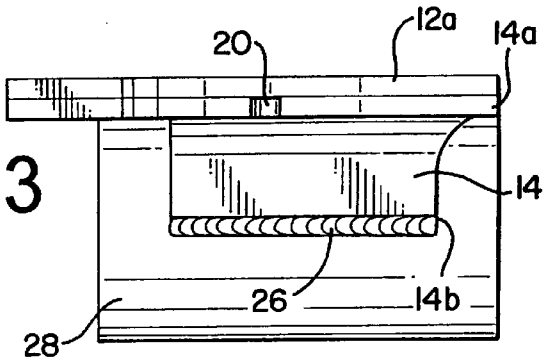
FIG. 3 is a top view of the mounting bracket according to the present invention; and, FIG. 4 is an end view of the mounting bracket according to the present invention.
Figure 4:
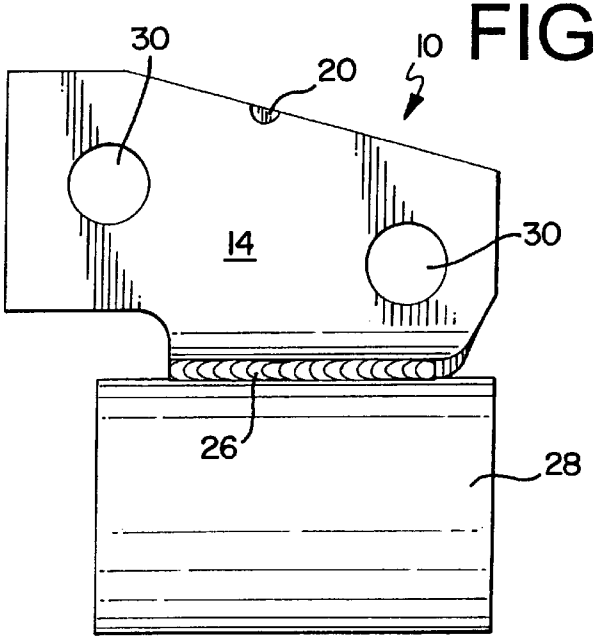

While this invention is susceptible to embodiment in many different forms, there is shown in the drawings, and will herein be described in detail, a preferred embodiment of the invention with the understanding that the present disclosure is to be considered as an exemplification of the principles of the invention and is not intended to limit the broad aspect of the invention to the embodiment illustrated.

As shown in FIGS. 1–4, the present invention is directed to a compound mounting bracket 10 for attaching a solenoid to a structure (not shown). Although the structure of a solenoid is not depicted in detail, the solenoid housing 28 is generally depicted in FIGS. 1–4. The solenoid used in connection with the present invention may be of the type described in U.S. Pat. No. 5,592,356. Alternatively, the solenoid may be any conventional solenoid generally known to those skilled in the art.

As shown in FIGS. 1–4, the mounting bracket 10 comprises a first plate 12 and a second plate 14. The first plate 12 has a first edge 12*a* and a second distal edge 12*b*. The second distal edge 12*b* of the first plate 12 is connectable to a first mounting point 16 on the outer housing of a solenoid. The second plate 14 is attached to the first plate 12 and similarly has a first edge 14*a* and a second distal edge 14*b*. The second distal edge 14*b* of the second plate 14 extends in a direction generally transverse to the first edge 14*a* of the second plate 14. The second plate 14 is connectable at its distal edge 14*b* to a second mounting point 18 on the solenoid housing 28. A dihedral angle a is formed between the first plate 12 and the second plate 14. Although the dihedral angle a shown in FIGS. 1–4 is a 90° angle, it is contemplated that the dihedral angle a be other than 90°.

More particularly, the first plate 12 is attached to the second plate 14 by a first weld 20 proximate the first edges 12*a*, 14*a* of the first and second plates 12, 14. In a preferred embodiment of the present invention, the first weld 20 is a tack weld located proximate the midpoint of the first edges 12*a*, 14*a* of the first and second plates 12, 14. It is, however, contemplated that the first and second plates 12, 14 be connected by any other suitable mechanisms for bonding metal to metal. It is also contemplated that the first weld 20 be other than a single tack weld. For example, it is suitable for the first weld 20 to be a continuous weld. Alternatively, the first weld 20 may be comprised of a plurality of tack welds applied over the length of the respective first edges 12*a*, 14*a* of the first and second plates 12, 14.

Figure 2:
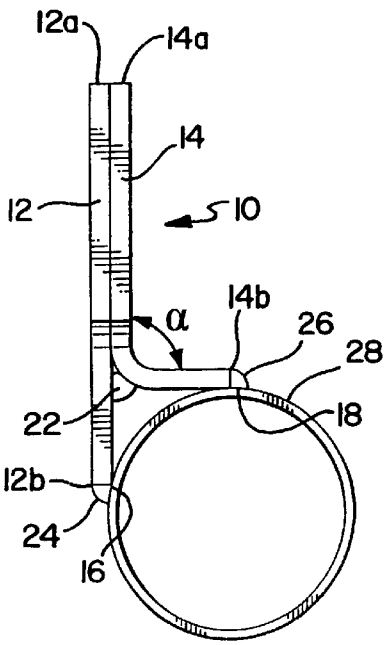
FIG. 2 is side view of the mounting bracket according to the present invention.
Figure 1:
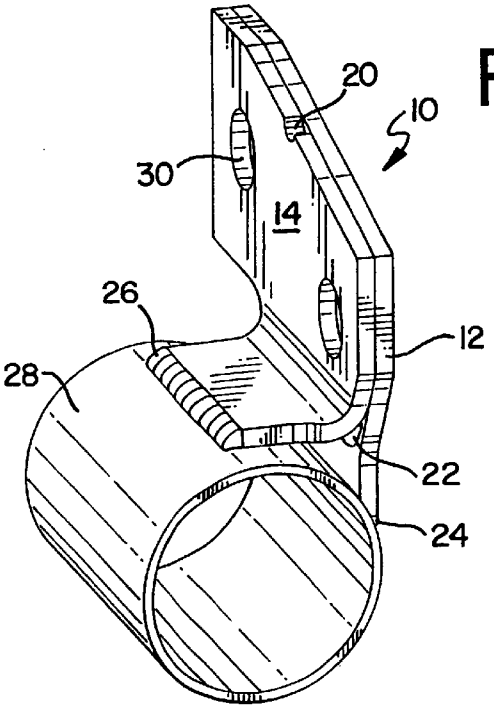
FIG. 1 is a perspective view of the mounting bracket according to the present invention.

Additionally, the first plate 12 is attached to the second plate 14 by a second weld 22 proximate the dihedral angle a defined by the first and second plates 12, 14. As shown in FIG. 2, the second weld 22 is generally continuous along the length of the dihedral angle a defined by the first and second plates 12, 14.

As may be seen in FIG. 2, the second distal edge 12*b* of the first plate 12 is attached to the first mounting point 16 on the solenoid housing 28 by a third weld 24. The second distal edge 14*b* of the second plate 14 is attached to the second mounting point 18 on the solenoid housing 28 by a fourth weld 26. According to a preferred embodiment, the third and fourth welds 24, 26 connecting the second distal ends 12*b*, 14*b* of the first and second plates 12, 14 to the respective first and second mounting points 16, 18 do not extend beyond the length of the respective second distal edges 12*b*, 14*b* of the first and second plates 12, 14.

The present invention is also directed to a method for attaching a solenoid to a mounting bracket 10. The method comprising the step of providing a solenoid having a generally cylindrical housing 28. The method also comprises the step of providing a first plate 12 and a second plate 14, each having a first edge 12*a*, 14*a* and a distal second edge 12*b*, 14*b*, wherein the second edge 14*b* of the second plate 14 extends in a direction generally transverse to the first edge 14*a* of the second plate 14, thereby defining a dihedral angle a between the first plate 12 and the second plate 14. The method further comprises the steps of: (1) applying a first weld 20 between the first edge 12*a* of the first plate 12 and the first edge 14*a* of the second plate 14; (2) applying a second weld 22 to the mounting bracket 10 between the first and second plates 12, 14 proximate the dihedral angle $\alpha$; (3) applying a third weld 24 between the second distal edge 12*b* of the first plate 12 and the solenoid housing 28; and (4) applying a fourth weld 26 between the second distal edge 14*b* of the second plate 14 and the solenoid housing 28. Once assembled, the solenoid and bracket 10 assembly may be attached to a surface via the mounting holes 30 in the bracket 10 using conventional fasteners. Although the preferred sequence for method of the present invention is described above, it is contemplated that the steps be performed in any sequence suitable to attach the mounting bracket 10 described herein to a solenoid housing 28.

While a specific embodiment has been illustrated and described, numerous modifications come to mind without significantly departing from the spirit of the invention and the scope of protection is only limited by the scope of the accompanying Claims.

We claim:

1. A mounting bracket for attaching a solenoid to a structure, the mounting bracket comprising:

a first plate having a first edge and a second distal edge, the second distal edge of the first plate being connectable to a first mounting point on a solenoid; and, a second plate attached to the first plate, the second plate having a first edge and a second distal edge, the second distal edge of the second plate extending in a direction generally transverse to the first edge of the second plate and defining a dihedral angle between the first plate and the second plate, the second plate being connectable at its second distal edge to a second mounting point on the solenoid.

2. The assembly of claim 1, wherein the first plate is attached to the second plate by a first weld proximate the first edge of the first and second plates and a second weld proximate the dihedral angle defined by the first and second plates.

3. The assembly of claim 2, wherein the first weld is a tack weld.

4. The assembly of claim 2, wherein the second weld is generally continuous along the length of the dihedral angle defined by the first and second plates.

5. A solenoid assembly comprising:

a solenoid having a generally cylindrical housing;

a bracket attached to the solenoid, the bracket comprising a first plate and a second plate, wherein the first and second plates each have a first edge and a second distal edge, the second distal edge of the second plate extending in a direction generally transverse to the first edge of the second plate and defining a dihedral angle between the first plate and the second plate; and, wherein the second distal edge of the first plate is attached to a first mounting point on the solenoid housing and a the second distal edge of the second plate is attached to a second mounting point on the solenoid housing.

6. The assembly of claim 5, wherein the first plate is attached to the second plate by a first weld proximate the first edge of the first and second plates and a second weld proximate the dihedral angle defined by the first and second plates.

7. The assembly of claim 6, wherein the first weld is a tack weld.

8. The assembly of claim 6, wherein the second weld is generally continuous along the length of the dihedral angle defined by the first and second plates.

9. The assembly of claim 5, wherein the second distal edge of the first plate is attached to the first mounting point on the solenoid housing by a weld and the second distal edge of the second plate is attached to the second mounting point on the solenoid housing by a weld.

10. The assembly of claim 9, wherein the second distal edges of the first and second plates each have a length and wherein the welds connecting the second distal ends of the first and second plates to the respective first and second mounting points do not extend beyond the length of the respective second distal edges of the first and second plates.

11. A method for attaching a solenoid to a mounting bracket, the method comprising the steps of:

providing a solenoid having a generally cylindrical housing;

providing a first plate and a second plate, the first and second plates each having a first edge and a distal second edge, the second edge of the second plate extending in a direction generally transverse to the first edge of the second plate and defining a dihedral angle between the first plate and the second plate;

applying a first weld between the first edge of the first plate and the first edge of the second plate;

applying a second weld to the mounting bracket between the first second plate proximate the dihedral angle, the second weld being generally continuous along the dihedral angle defined by the first and second plates;

applying a third weld between the second distal edge of the first plate and the solenoid housing; and, applying a fourth weld between the second edge distal edge of the second plate and the solenoid housing.

12. The method of claim 11 wherein the first weld is a tack weld.

13. The method of claim 11 wherein the third and fourth welds are generally continuous.

14. The method of claim 13, wherein the second distal edge of the first plate has a length and the third weld does not extend beyond the length of the second distal edge of the first plate.

15. The method of claim 13, wherein the second distal edge of the second plate has a length and the fourth weld does not extend beyond the length of the second distal edge of the second plate.

* * * * *